US007123824B2

(12) United States Patent
Altman et al.

(10) Patent No.: US 7,123,824 B2
(45) Date of Patent: Oct. 17, 2006

(54) SYSTEM AND METHOD FOR GENERATING STEAM FOR A STEAM BATH

(75) Inventors: Mitchell Altman, 2255 Union Pl., Simi Valley, CA (US) 93065; Scott Sharitz, Oxnard, CA (US)

(73) Assignee: Mitchell Altman, Simi Valley, CA (US)

( * ) Notice: Subject to any disclaimer, the term of this patent is extended or adjusted under 35 U.S.C. 154(b) by 0 days.

(21) Appl. No.: 11/290,191

(22) Filed: Nov. 29, 2005

(65) Prior Publication Data

US 2006/0133783 A1 Jun. 22, 2006

Related U.S. Application Data

(63) Continuation of application No. 11/015,814, filed on Dec. 16, 2004, now abandoned.

(51) Int. Cl.
*F24H 1/18* (2006.01)

(52) U.S. Cl. ..... 392/459; 392/399; 392/386

(58) Field of Classification Search ..... None
See application file for complete search history.

(56) References Cited

U.S. PATENT DOCUMENTS 3,410,986 A * 11/1968 Groom ..... 392/399
3,910,498 A * 10/1975 Harrison ..... 239/137
4,046,989 A 9/1977 Parise
4,320,702 A * 3/1982 Shein et al. ..... 122/4 A
4,668,854 A * 5/1987 Swan ..... 392/399
4,697,735 A * 10/1987 Temple ..... 236/44 C
4,881,493 A * 11/1989 Riba ..... 392/400
6,148,144 A * 11/2000 Milanese ..... 392/405
6,393,212 B1 * 5/2002 Hutchinson ..... 392/491
6,647,204 B1 * 11/2003 Hutchinson ..... 392/491
6,659,048 B1 12/2003 DeSantis

* cited by examiner

*Primary Examiner*—Thor S. Campbell
(74) *Attorney, Agent, or Firm*—Seldon & Scillieri

(57) ABSTRACT

A steam generator for use with a steam bath has a storage tank for holding a quantity of water from which steam is to be made, means for permitting the ingress of water and the egress of steam from the tank, first heating means for controllably maintaining the water at a temperature that is elevated from the ambient temperature but below its boiling point, and second heating means for selectively heating the water from its elevated temperature to produce steam upon demand.

18 Claims, 2 Drawing Sheets

SYSTEM AND METHOD FOR GENERATING STEAM FOR A STEAM BATH

Figure 1:
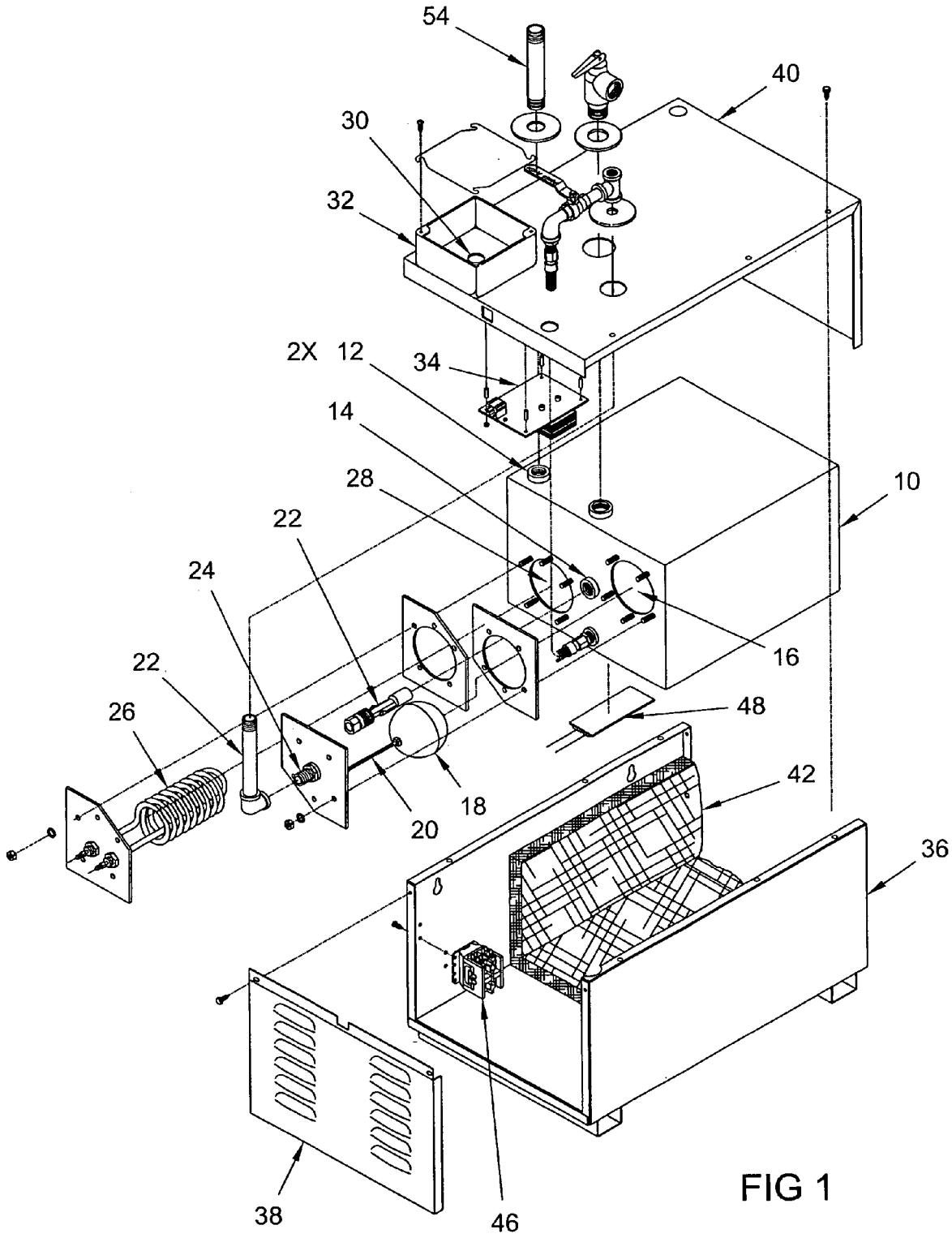

This application is a continuation of co-pending U.S. patent application Ser. No. 11/015,814 filed Dec. 16, 2004 now abandoned, the priority of which is claimed.

FIELD OF THE INVENTION

This invention relates to steam bath systems and, more specifically, to steam bath systems having electric heaters for generating the steam.

BACKGROUND OF THE INVENTION

Steam baths have long been a popular method for relaxing and renewing one's energy level. Many people also believe that steam baths have a number of health benefits. Typical steam baths require a mist to be permanently present, requiring energy-intensive components and methods for generating steam.

In practice, those who take steam baths typically do so for 15–20 minutes, sometimes followed by a shower to cool down the body and a second steam bath. Moreover, this can be repeated as many as two to three times for a single session. Steam baths accordingly require a sufficient quantity of water to be heated to its boiling point of 100° C. to produce the requisite amount of steam. This can be quite energy intensive.

In addition, it can take considerable time to heat the required quantity of water to its boiling point; typically, as long as four to six minutes. This is inconvenient, particularly given the fact that the steam bath is taken for 15–20 minutes, as described above. The proportion of total time thereby devoted to waiting for steam is significant. Although one can theoretically utilize the heated water from a home's hot water heater to reduce the waiting time by reducing the temperature gradient that must be transversed to produce steam, the water from a hot water heater typically contains impurities that can harm the steam bath system, shorten its life, and detract from the beneficial health effects attributable to steam baths. Thus, one has typically had to wait a considerably lengthy time before one could engage in a desired steam bath

SUMMARY OF THE INVENTION

The invention herein is directed to a steam generator for use with a steam bath having a storage tank for holding a quantity of water from which steam is to be made, means for permitting the ingress of water and the egress of steam from the tank, first heating means for controllably maintaining the water at a temperature that is elevated from the ambient temperature but below its boiling point, and second heating means for selectively heating the water from its elevated temperature to produce steam.

Further details concerning the invention will be appreciated from the following detailed description of the invention, of which the drawing is a part.

THE DRAWING

Figure 2:
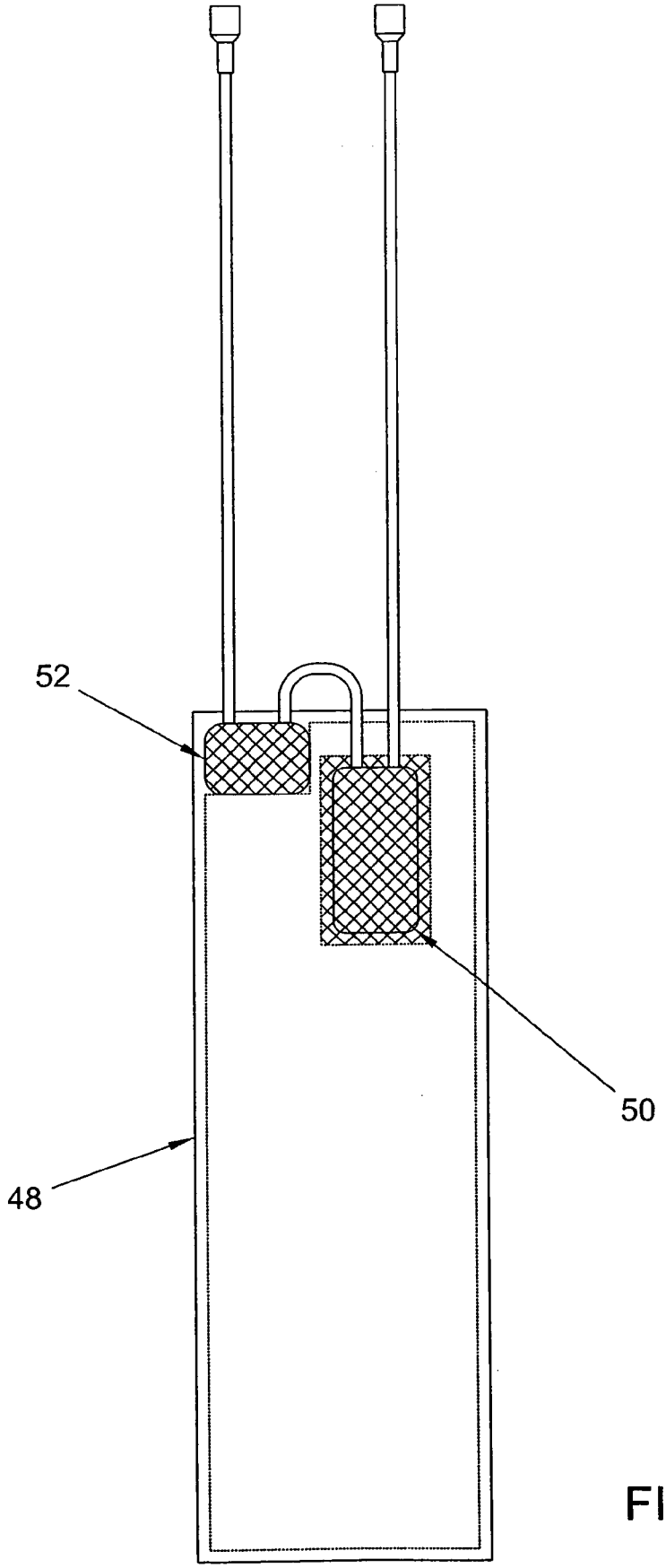

In the drawing,

FIG. 1 is an isometric view in explosion of a steam-bath heating unit constructed in accordance; and FIG. 2 is a top plan view of the preheater element used in accordance with the invention.

DETAILED DESCRIPTION OF THE INVENTION

FIG. 1 is an isometric view in explosion of a steam-bath heating unit constructed in accordance with the invention. The system comprises a stainless steel boiler tank 10 which can be of any convenient size and shape. The system we have constructed utilizes a square 2 gallon tank having dimensions of approximately 9 inches in height, 10 inches in depth, and 10 inches in width.

The tank 10 has a steam outlet port 12, which is typically ½" in diameter, as well as a water inlet port 16 through which a water enters the tank via an external inlet nipple from an inlet pipe 22. A float 18, inserted into the tank through the inlet port, extends within the tank from a stem 20 is operatively connected to a flapper valve at the inlet port 14 to close the flapper when the water level in the tank reaches the maximum desired level, and to open the flapper when the water level is lower than the maximum desired level to permit the ingress of more water.

A heater coil 26 is inserted into the tank through a coil-receiving port 28 to heat the water to its boiling point and thereby create the steam that emerges from the steam outlet port. The heater coil 26 is an electrically resistive element that is responsive to the flow of electricity within the coil to sufficiently heat the water in which it is immersed to raise the water temperature to the boiling point. Preferably, the heating coil is a 220 volt, 6 KW heater. The heating coil 26 is electrically coupled through a circuit board 34 to a source of household current, which is fed through a port 30 in a junction box 32 to an electric circuit board 34.

Those skilled in the art will recognize that is the heating element 26 need not the coil shaped, and that any desirable configuration for the heating element can be used. In addition, a source of heat other than an electrically heated element can be used. For example, steam maybe generated using natural gas and a gas burner. Similarly, other fuels and energy sources can be utilized, and it should be understood that this invention is not limited to the use of electrically heated coils or similar electrically heated elements.

The heating coil 26 can preferably be disabled by a water level sensing switch 22 that is inserted in to the tank via a port 14. The level sensing switch 22 operates to electrically decouple the heating element 26 from its current source if the water level in the tank 10 falls below a desired minimum level. The switch 22 thereby acts as a safety device to ensure that the heat generated by the element 26 is sufficiently dissipated within the water, and will not continue to operate when there is an insufficient amount of water for this purpose.

The tank 10 is located within a housing comprising a lower section 36, a front panel 38, and a top panel 40. The tank 10 is nested within a layer of thermal insulation 42 disposed within the lower section 36 of the housing. A preheater 48 is affixed to the portion of one wall of the tank 10 with a suitable adhesive to transfer heat through the tank wall and into the water, as explained below.

FIG. 2 is a top plan view of the preheater 48 used in accordance with the invention. The preheater is preferably a Kapton™ heater. Heaters of this type typically comprise an external layer of magnesium powder, which conducts heat but not electricity, together with a more interior layer of electrically conductive, but suitably resistive, material. The preferred preheater comprises a thin, substantially flat, 1.5 inch×4.5 inch external strip 49 having an internal foil-like resistive heating element disposed within the illustrated dotted line 50. The resistive heating element is preferably characterized by 750 ohm of resistance to produce a suitable amount of heat in response to the application of electric current.

The preheater 48 is electrically coupled to household current through a thermostatic switch 52 positioned on the strip for thermal coupling to the tank's surface when the preheater 48 is affixed to the tank. The switch 52 is preferably affixed to the preheater 48 with a suitable epoxy or other adhesive. The current source is electrically coupled to the thermostat switch and resistive heating element via leads 50*a*, 50*b*.

The preheater 48 is affixed to the tank with the thermostat switch 52 thermally coupled to the water inside the tank via the tank's wall. When the water in the tank is below the desired temperature range, the thermostat closes, completing the circuit and activating the preheater. When the water in the tank reaches the upper end of the desired temperature range, the thermostat switch opens, breaking the circuit and deactivating the preheater 48. Preferably, the water is maintained just 20–50° F. below the water's boiling point.

In operation, the preferred preheater utilizes approximately 80 watts of power when activated by the thermostat to maintain the water within the desired temperature range. When steam is desired, the heating coil 26 is energized by the user, and steam is produced from the preheated water within approximately 3–4 minutes. Thus, the relatively energy-intensive heating coil 26 is used minimally, with minimal power being consumed at other times in maintaining the water at an elevated temperature below its boiling point. Energy savings is achieved, and the inconvenience of waiting for a substantial period of time for steam production is avoided.

The steam emanating from the tank 10 exits from the housing through the steam discharge port 12, and is conducted towards the steam bath enclosure by a steam outlet conduit 54 that is typically screwed into the port or sealingly fastened to it by other appropriate means.

Although the present invention and its advantages have been described in detail, it should be understood that various changes, substitutions and alterations can be made herein without departing from the spirit and scope of the invention as defined by the appended claims.

We claim:

1. Steambath apparatus comprising:

a tank for holding a sufficient quantity of water to provide steam for a steam bath; a valve for selectively permitting the ingress of water into the tank:

an outlet permitting the egress of steam from the tank for provision to the steam bath;

a relatively low wattage heater element thermally coupled to the water held in the tank, the relatively low wattage heater element comprising a metallic electrically resistive foil material formed on a matrix of heat-conducting, electrically insulating material:

a temperature-responsive switch operatively coupled to the relatively low wattage heater element to maintain the temperature of the water at a higher level than the temperature exterior to the tank but below the boiling temperature of the water;

a relatively high wattage heater element thermally coupled to the water held in the tank, said relatively low wattage heater element being in the range of approximately 0.5% to approximately 5.0% of the wattage of the relatively high wattage heater element;

a second switch operatively connected to the relatively high wattage each heater element to heat the water held in the tank to its boiling point to produce steam for the steam bath upon demand by a user.

2. The steam bath apparatus of claim 1 wherein the tank has at least one heat-conducting surface, and the relatively low wattage heat element is thermally coupled to the water through the heat-conducting surface.

3. The steam bath apparatus of claim 2 wherein the relatively low wattage heat element is affixed to the exterior of the tank.

4. The steam generating system of claim 2 wherein the relatively low wattage heat element is affixed to the bottom exterior of the tank.

5. The steam bath apparatus of claim 2 wherein the relatively low wattage heat element is affixed generally centrally to the bottom exterior of the tank.

6. The steam bath apparatus of claim 1 including a liquid-level sensor for sensing the level of the water within the tank.

7. The steam bath apparatus of claim 6 wherein the valve is responsive to the liquid-level sensor to permit additional water into the tank when the level is less than a desired minimum level.

8. The steam bath apparatus of claim 7 wherein the liquid-level sensor is operatively connected to the valve for stopping the flow of additional water into the tank when the water level in the tank reaches a desired maximum level.

9. The steam bath apparatus of claim 1 including means for disabling the relatively high wattage heater when the water level is less than a desired minimum level.

10. The steam bath apparatus of claim 1 wherein the temperature-responsive switch is configured to operative the relatively low wattage heater element to maintain the temperature of the water within a temperature band in the range of approximately 20–50° F. below the water's boiling point.

11. The steam bath apparatus of claim 1 wherein the tank is sized to hold approximately 2 gallons of water.

12. A method for quickly producing steam for use in a steam bath comprising the steps of:

holding a quantity of water in a tank for conversion on demand into steam for a steam bath using a heating element at a relatively high wattage:

using a metallic electrically resistive foil material formed on a matrix of heat-conducting electrically insulating material as a low wattage heater element at approximately 0.5% to approximately 5.0% of the high wattage to maintain the temperature of the water in the tank at a higher level than the ambient temperature exterior to the tank, but below the boiling temperature of the water, so that steam is produced more quickly when desired than the time taken by the high wattage heater to heat the water from the ambient temperature.

13. The method of claim 12 including the steps of:

energizing the relatively high wattage heater element thermally coupled to water held in a tank to produce steam when steam is desired by a user; and energizing the relatively low wattage heater element at other times.

14. The method of claim 13 including the step of thermally coupling the low wattage heater to the water through the wall of the tank.

15. The method of claim 13 including the step of thermally coupling the low wattage heater to the water through the bottom wall of the tank.

16. The method of claim 13 including the step of disabling at least one of the low wattage heater element and the high wattage heater element if the level of water in the tank falls below a desired minimum.

17. The method of claim 13 including the steps of permitting additional water into the tank when the level is less than a desired minimum level, and stopping the flow of additional water into the tank when the water level in the tank reaches a desired maximum level.

18. The method of claim 13 including the step of maintain the temperature of the water at said other times within a temperature band in the range of approximately 20–50° F. below the water'boiling point.

* * * * *